US009665045B2

(12) United States Patent
Matsubara

(10) Patent No.: US 9,665,045 B2
(45) Date of Patent: May 30, 2017

(54) FIXING DEVICE AND IMAGE FORMING APPARATUS

(71) Applicant: FUJI XEROX CO., LTD., Tokyo (JP)

(72) Inventor: Takashi Matsubara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/994,797

(22) Filed: Jan. 13, 2016

(65) Prior Publication Data

US 2017/0052488 A1 Feb. 23, 2017

(30) Foreign Application Priority Data

Aug. 19, 2015 (JP) ..... 2015-162220

(51) Int. Cl.
*G03G 15/20* (2006.01)

(52) U.S. Cl.
CPC ..... *G03G 15/2007* (2013.01)

(58) Field of Classification Search
CPC ..... G03G 15/2007
USPC ..... 399/336
See application file for complete search history.

(56) References Cited

U.S. PATENT DOCUMENTS

| | | | |
|---|---|---|---|
| 7,035,556 | B2 | 4/2006 | Behnke et al. |
| 9,229,378 | B1 | 1/2016 | Matsubara et al. |
| 2011/0262196 | A1 | 10/2011 | Maeda |
| 2012/0045238 | A1 | 2/2012 | Maeda |
| 2012/0045239 | A1 | 2/2012 | Maeda |
| 2014/0093289 | A1 | 4/2014 | Ishii et al. |
| 2014/0140743 | A1* | 5/2014 | Akuta ..... G03G 15/2007 399/336 |
| 2014/0241765 | A1 | 8/2014 | Kodera |
| 2015/0093170 | A1* | 4/2015 | Kodera ..... G03G 15/2007 399/336 |

FOREIGN PATENT DOCUMENTS

| | | |
|---|---|---|
| JP | 2011-128223 A | 6/2011 |
| JP | 2014-164022 A | 9/2014 |

OTHER PUBLICATIONS

U.S. Appl. No. 14/706,496, filed May 7, 2015.
U.S. Appl. No. 14/699,346, filed Apr. 29, 2015.
Apr. 26, 2016 Office Action issued in U.S. Appl. No. 14/699,346.
Oct. 6, 2015 Office Action issued in U.S. Appl. No. 14/699,346.

* cited by examiner

*Primary Examiner* — Sandra Brase
(74) *Attorney, Agent, or Firm* — Oliff PLC

(57) ABSTRACT

A fixing device includes a light source, a contact member, and an incident unit. The contact member transmits light from the light source and includes a contact portion that contacts with an image forming material on a medium while rotating. The image forming material on the medium is heated by light in the contact portion. The incidence unit causes the light from the light source to be incident on the contact member so that a second image forming material, attached to the contact member by a first image forming material attached to the contact member shielding at least a part of the light from the light source, shields only a part of the light when the first image forming material is located at the contact portion, or does not shield any of the light when the first image forming material is located at the contact portion.

15 Claims, 15 Drawing Sheets

COMPARATIVE EXAMPLE

COMPARATIVE EXAMPLE

COMPARATIVE EXAMPLE

COMPARATIVE EXAMPLE

FIXING DEVICE AND IMAGE FORMING APPARATUS

CROSS-REFERENCE TO RELATED APPLICATIONS

This application is based on and claims priority under 35 USC 119 from Japanese Patent Application No. 2015-162220 filed Aug. 19, 2015.

BACKGROUND

Technical Field

The present invention relates to a fixing device and an image forming apparatus.

SUMMARY

In the configuration that when a contact member transmitting light and rotating and an image forming material contact with each other, the image forming material is heated by the transmitted light and a portion on which the light is incident and a contact portion are disposed so as to be shifted from each other by 180 degrees in a circumferential direction of the contact member, a part of light is shielded by the image forming material attached to a transmission member for some reason, when the attached image forming material reaches the light incident portion of the contact member. Thereby, the intensity of light at the contact portion where the image forming material and the contact member contact with each other is lowered, and thus a further image forming material may be attached to the image forming material attached to the contact member.

According to an aspect of the invention, a fixing device includes alight source, a contact member, and an incident unit. The contact member transmits light from the light source and includes a contact portion that contacts with an image forming material on a medium while rotating. The image forming material on the medium is heated by light in the contact portion. The incidence unit causes the light from the light source to be incident on the contact member so that a second image forming material, attached to the contact member by a first image forming material attached to the contact member shielding at least a part of the light from the light source, shields only a part of the light when the first image forming material is located at the contact portion, or does not shield any of the light when the first image forming material is located at the contact portion.

BRIEF DESCRIPTION OF THE DRAWINGS

Exemplary embodiments of the present invention will be described in detail based on the following figures, wherein.

DETAILED DESCRIPTION

First Exemplary Embodiment

Examples of a fixing device and an image forming apparatus according to a first exemplary embodiment will be described.

Overall Configuration

Figure 1:
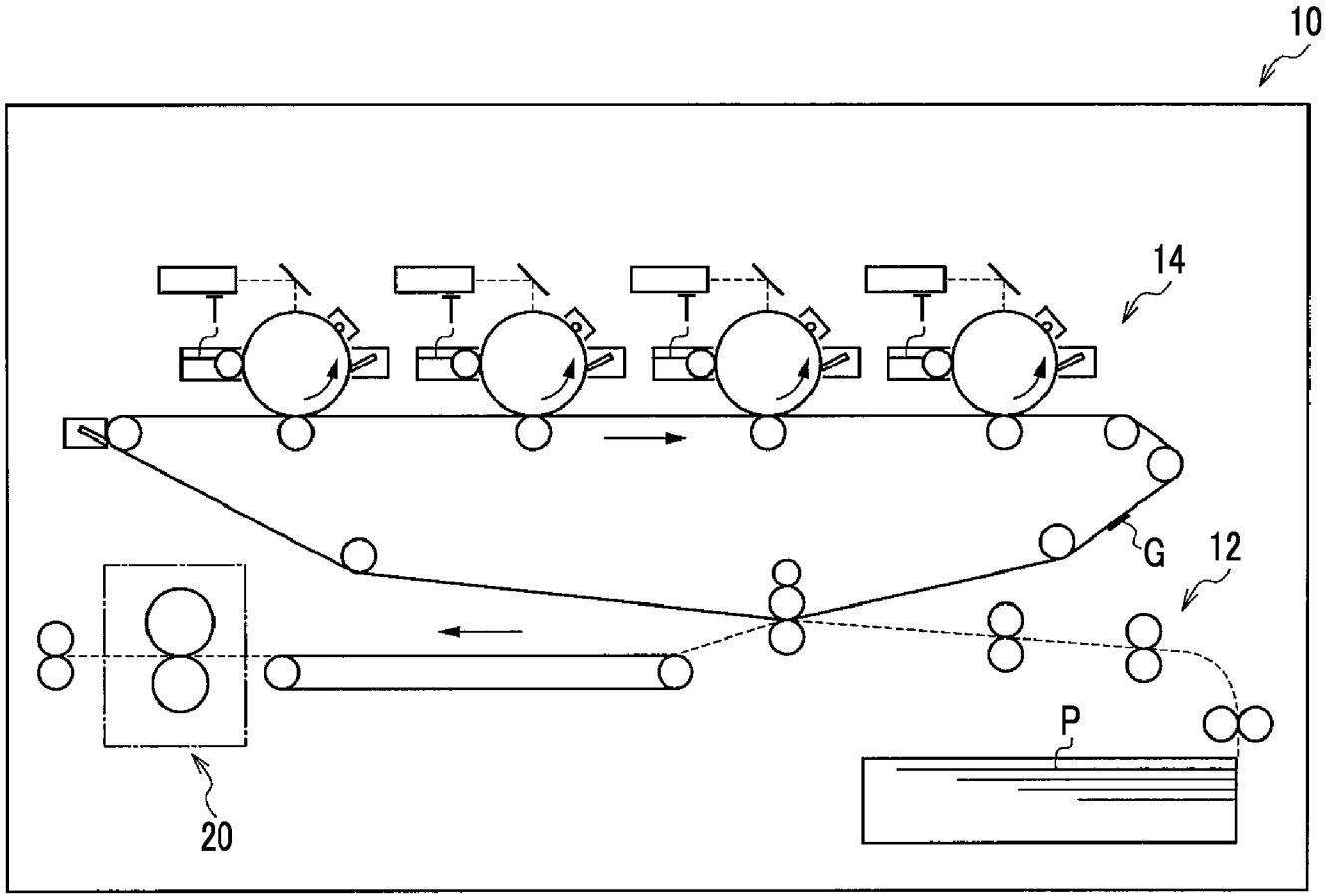
FIG. 1 is an entire configuration diagram illustrating an image forming apparatus according to a first exemplary embodiment.

FIG. 1 illustrates an image forming apparatus 10 according to the first exemplary embodiment. The image forming apparatus 10 includes a transport section 12 that transports paper P as an example, an image forming section 14 that forms a toner image G using a toner T on the transported paper P, and a fixing device 20 that heats the toner image G and fixes the heated toner image onto the paper P. The paper P is an example of a medium. The toner T is an example of an image forming material, a developer, and an object to be heated. The toner image G is an example of a developer image. The image forming section 14 is an example of a developer image forming unit. In addition, the image forming section 14 performs charging, exposure, develop, transfer, and cleaning processes. In the following description, a transport direction of the paper P in the fixing device 20 will be referred to as an A-direction.

Main Components

Next, the fixing device 20 will be described.

Figure 2:
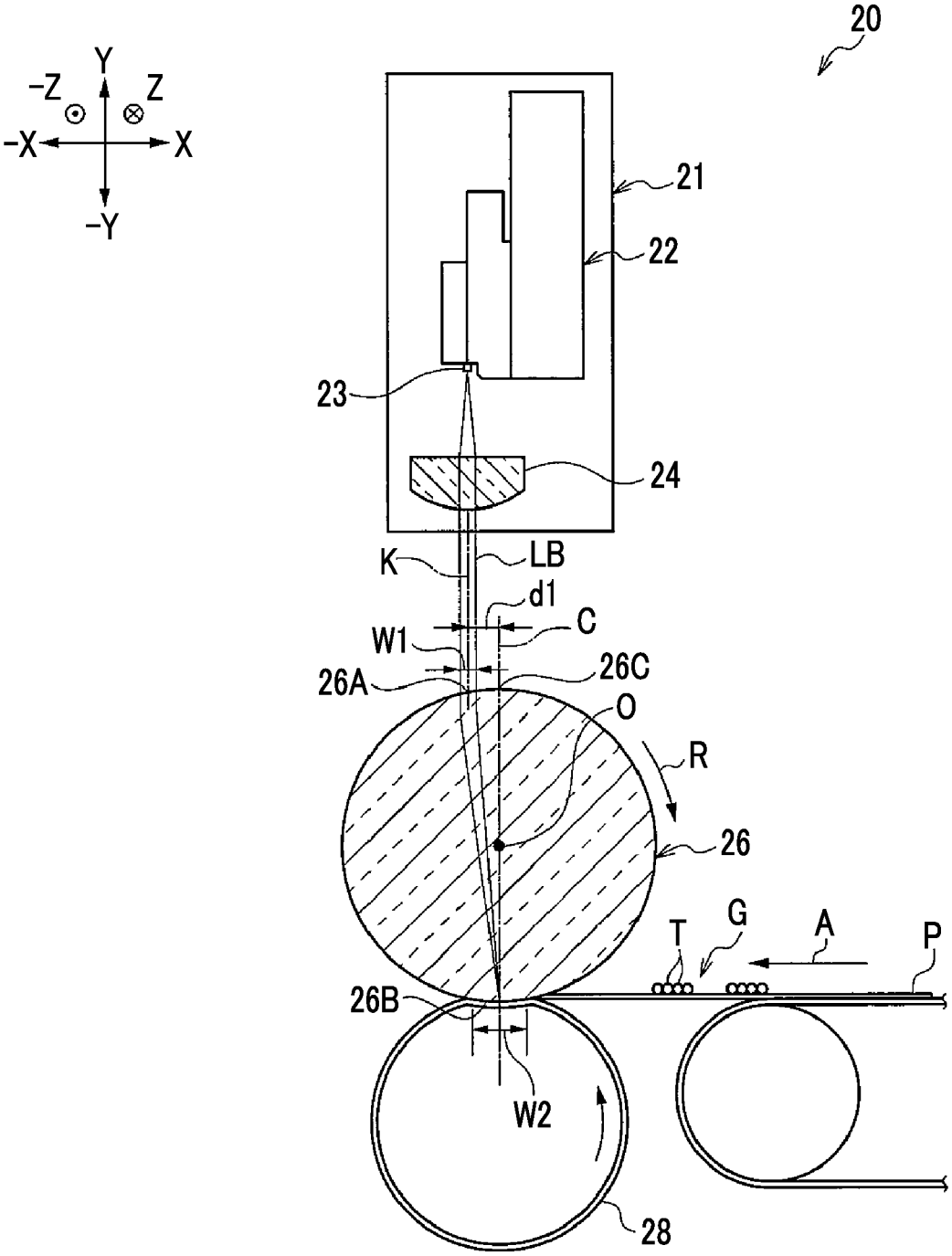
FIG. 2 is a configuration diagram illustrating a fixing device according to the first exemplary embodiment.

As illustrated in FIG. 2, the fixing device 20 includes a laser array 22 as an example of a light source, a lens 26 as an example of a contact member, and a collimator lens 24 as an example of an incidence unit. Further, the fixing device 20 includes a facing roller 28 facing the lens 26. Meanwhile, a portion including the laser array 22 and the collimator lens 24 will be referred to as a light irradiation section 21.

Laser Array

Figure 3:
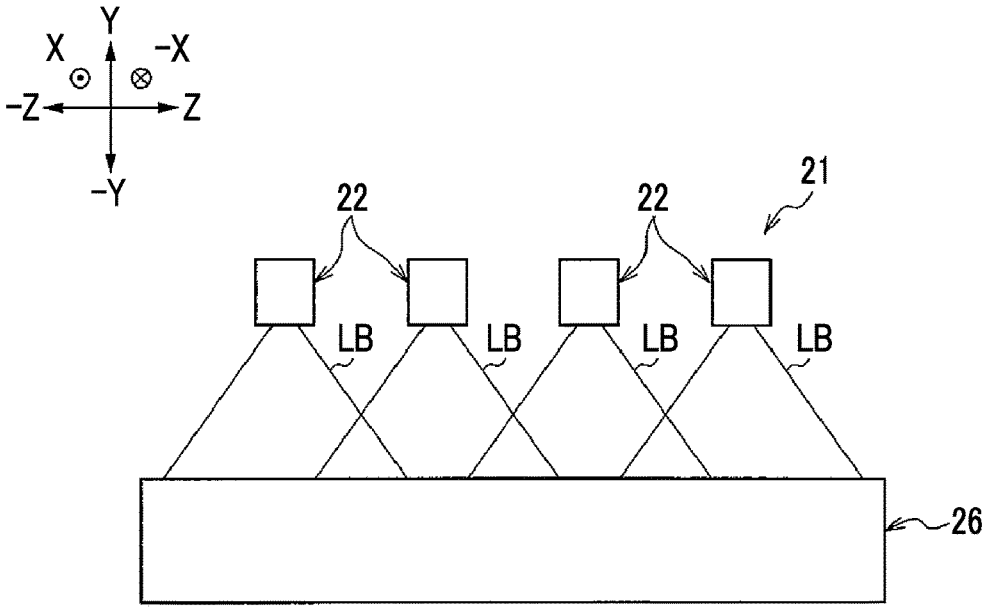
FIG. 3 is a diagram illustrating the arrangement of plural laser arrays in a longitudinal direction of a lens according to the first exemplary embodiment.

As illustrated in FIG. 3, the plural laser arrays 22 are provided in the light irradiation section 21 so as to be lined up in one direction. Here, a direction in which the laser arrays 22 are lined up will be referred to as a Z-direction, a direction which is perpendicular to the Z-direction and in which a light beam LB is emitted to the lens 26 from the laser array 22 will be referred to as a Y-direction, and a direction perpendicular to the Z-direction and the Y-direction will be referred to as an X-direction. As an example, the X-direction is a direction which is substantially parallel to the A-direction (see FIG. 2). In other words, in the present exemplary embodiment, the laser array 22 causes the light beam LB to be incident on the lens 26 along the Y-direction perpendicular to the A-direction.

When it is necessary to distinguish between one side and the other side of each of the X-direction, the Y-direction, and the Z-direction, an upper side, a lower side, a right side, a left side, a back side, and a front side will be described as a Y side, a −Y side, an X side, an −X side, a Z side, and a −Z side, respectively, when the laser array 22 is seen along the Z-direction. As an example, the paper P is configured to be transported from the X side to the −X side. In addition, the laser arrays 22 are configured such that plural laser light sources 23 (see FIG. 2) are arrayed along the Z-direction.

As illustrated in FIG. 2, the laser light source 23 causes the light beam LB traveling along the Y-direction to be incident on a surface of the collimator lens 24 on the Y side when seen in the Z-direction. In addition, as illustrated in FIG. 3, the laser array 22 causes the light beam LB spreading in the Z-direction to be incident on the outer circumferential surface of the lens 26 when seen in the X-direction. Further, the laser arrays 22 are arrayed so that a part of the light beam LB of the adjacent laser array 22 is incident on the outer circumferential surface of the lens 26 in an overlapping manner. Meanwhile, in FIG. 3, the collimator lens 24 (see FIG. 2) is not shown.

Lens

As illustrated in FIG. 2, the lens 26 is an optical member that transmits the light beam LB having passed through the collimator lens 24 and condenses light, and includes, for example, a cylindrical (solid) rod lens which is disposed on the −Y side of the collimator lens 24 and the Y side of the facing roller 28 to be described later. The lens 26 is configured such that a transparent rubber layer and a PFA (a copolymer of tetrafluoroethylene and perfluoroalkyl vinyl ether) layer are formed on the outer circumferential surface of a cylindrical glass roll. In other words, the lens 26 is configured such that a shape of an X-Y cross-section thereof is a circular shape when seen in the Z-direction serving as a longitudinal direction.

As an example, a slippage bearing, not shown in the drawing, is fitted into both ends of the lens 26 in the Z-direction. In addition, a gear, not shown in the drawing, is fitted into the end of the lens 26 on the Z side. The lens 26 rotates in association with the gear rotating around its own axis (Z-axis) by a driving source not shown in the drawing. Further, the lens 26 comes into contact with the toner image G on the paper P while rotating. Meanwhile, a circumferential direction and a rotation direction of the lens 26 are referred to as an R-direction.

A portion on which the light beam LB is incident from the collimator lens 24 on the outer circumferential surface of the lens 26 is referred to as an incident portion 26A. Here, an axis that passes through a center O of the lens 26 in the X-Y cross-section and is perpendicular to the Y-direction is referred to as an axis C (indicated by a dashed line), and an optical axis of the light beam LB is referred to as an optical axis K (indicated by a dashed line). The axis C and the optical axis K are separated from each other in the X-direction by a distance d1. That is, the incident portion 26A is set at a position separated from the axis C in the X-direction by the distance d1. In addition, the width of the incident portion 26A in the X-direction when the incident portion is projected on an X-Z plane is set to be W1. Meanwhile, in FIG. 2, the optical axis of the light beam LB condensed within the lens 26 is not shown.

On the other hand, a portion which is on the outer circumferential surface of the lens 26, on which the light beam LB incident from the incident portion 26A is condensed (which is illuminated with the light beam LB), which comes into contact with the toner T on the paper P, and at which the toner T on the paper P is heated by the light beam LB is referred to as a contact portion 26B. The contact portion 26B is a portion equivalent to a nip portion where the outer circumferential surface of the lens 26 contacts with the outer circumferential surface of the facing roller 28 to be described later in a state where there is no paper P. In addition, the center of the contact portion 26B in the R-direction is located on the axis C. The width of the contact portion 26B in the X-direction from an entry position of the paper P to an exit position when the contact portion is projected on the X-Z plane is set to be, for example, a width W2 which is larger than the width W1 of the incident portion 26A. Meanwhile, the actual width of the condensed light beam LB in the X-direction in the contact portion 26B is smaller than the width W2.

In addition, a portion (position) shifted from the center of the contact portion 26B in the X-direction by 180 degrees ([° ]) in the R-direction in the outer circumferential surface of the lens 26 is referred to as a facing portion 26C. Here, the center of the contact portion 26B in the X-direction and the facing portion 26C are located on the axis C when seen in the Z-direction. In other words, the incident portion 26A is a portion shifted from the facing portion 26C by the distance d1 in the R-direction. The lens 26 condenses the light beam LB incident on the incident portion 26A toward the center of the contact portion 26B in the X-direction.

Here, a description will be given of a case where an incidence position of the light beam LB in the lens 26 is indicated by an angle in the R-direction from the contact portion 26B. In this case, the angle indicating the incidence position is defined as an angle between a line (axis C) connecting the position of the center of the contact portion 26B in the R-direction and the center O (rotation axis) of the lens 26 and a line connecting the center O and the incidence position.

In FIG. 2, the light beam LB incident on the lens 26 is schematically illustrated so as to be condensed on one point in the contact portion 26B, but the light beam LB is actually set to be in a condensing state in which the light beam has a width in the R-direction in the contact portion 26B. Meanwhile, in the following description, the attachment of the toner T onto the outer circumferential surface of the lens 26 will be referred to as an offset of the toner T.

Collimator Lens

As illustrated in FIG. 2, the collimator lens 24 is a plano-convex lens that changes the light beam LB emitted from the laser light source 23 into parallel light. In addition, the shape and arrangement of the collimator lens 24 are set so that at least a part of the light beam LB from the laser array 22 is incident on a portion of the lens 26 (shifted from the facing portion 26C in the R-direction) which is different from the facing portion 26C. Further, the collimator lens 24 causes at least a part of the light beam LB from the laser array 22 to be incident on a side which is closer to the downstream side than the contact portion 26B and is closer to the upstream side than the facing portion 26C in the R-direction.

Although described later in detail, the collimator lens 24 is disposed at a position where toners T which are secondly and thirdly offset on the lens 26 do not shield any of the light beam LB directed to the toner T which is firstly offset on the lens 26, by the firstly offset toner T shielding at least a part of the light beam LB. In other words, the collimator lens 24 causes the light beam LB to be incident on the lens 26 so that the incident portion 26A of the light beam LB and the contact portion 26B in the lens 26 do not face each other at an angle of 180 degrees in the circumferential direction of the lens. Meanwhile, in FIG. 2, the collimator lens 24 is illustrated in an enlarged manner.

Further, the position of the collimator lens 24 in the Y-direction is adjusted so that the width of the incident portion 26A of the lens 26, which is to be described later, when the incident portion is projected on the X-Z plane is set to be W1 when seen in the Z-direction. In addition, the collimator lens 24 is disposed so as to cause the light beam LB to be incident on only a portion except for the facing portion 26C of the lens 26. As an example, the collimator lens 24 is disposed so as to satisfy the relation of $(d1-W1/2)>W2/2$ with respect to the distance d1, the width W1, and the width W2.

Although not shown in the drawing, the length of the outer circumferential surface of the lens 26 is set to be L1, the length of an arc between the central position of the contact portion 26B in the R-direction and the central position of the incident portion 26A in the R-direction is set to be L2, and the length of an arc between the central position of the incident portion 26A in the R-direction and the central position of the contact portion 26B in the R-direction is set to be L3. The relation of $L1=L2+L3$ is established. In addition, the relation of $L2<L3$ is established. Here, it is assumed that the toner T which is offset on the lens 26 illustrated in FIG. 2 is fixed (recovered) onto the paper P when the lens 26 makes one rotation. In this case, the relation of $L2<L3$ is established, the (offset) toners T which are once disposed at the incident portion 26A and the contact portion 26B on the light path of the light beam LB are not located on the light path of the light beam LB again when the lens 26 rotates.

Facing Roller

The facing roller 28 is formed of, for example, a resin and is formed to have a cylindrical shape with the Z-direction as an axial direction. A cap not shown in the drawing is fitted into both ends of the facing roller 28 in the Z-direction to increase the rigidity of the facing roller 28. In addition, a gear not shown in the drawing is provided on one end side of the facing roller 28 in the Z-direction. The facing roller 28 rotates in association with the gear rotating around its own axis by a driving source not shown in the drawing.

Further, a portion of the outer circumferential surface of the facing roller 28 comes into contact with the lens 26 from the −Y side to thereby form the contact portion 26B mentioned above. That is, the facing roller 28 has a function to press the paper P by the lens 26 in the contact portion 26B.

Here, in the fixing device 20, the optical axis K is shifted in the X-direction with respect to the axis C as described above, and thus the position of the laser array 22, the position of the incident portion 26A, and the position of the contact portion 26B are not arranged on the same straight line. Meanwhile, in a member which the light beam LB is incident on and which is illuminated with the light beam LB, refraction occurs at an interface between air and the member, but the refraction is not shown in each of the drawings.

COMPARATIVE EXAMPLE

FIGS. 15A to 15D illustrate a process in which the offset of a toner T occurs in a fixing device 200 according to a comparative example. The fixing device 200 is configured such that the center of the incident portion 26A in the X-direction is disposed so as to be shifted from the contact portion 26B by 180 degrees in the R-direction in the fixing device 20 (see FIG. 2) according to the present exemplary embodiment, and the width of the incident portion 26A in the X-direction is smaller than the width of the contact portion 26B in the X-direction. Meanwhile, in FIGS. 15A to 15D, a toner T which is not offset on the lens 26 is not shown.

Figure 15A:
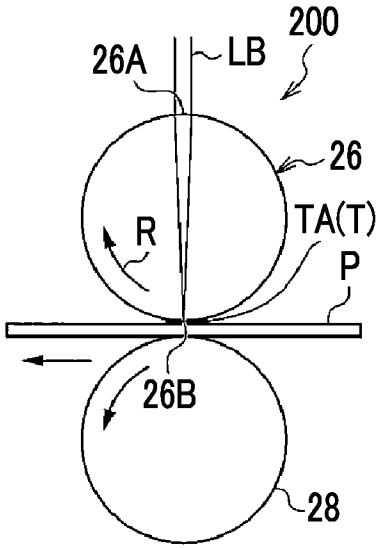
FIGS. 15A to 15D are diagrams illustrating a state where the offset of a toner on a lens increases in a fixing device according to a comparative example.

As illustrated in FIG. 15A, in the fixing device 200, it is assumed that a toner TA which is a portion of the toner T is offset on the outer circumferential surface of the lens 26 due to insufficient intensity of the light beam LB. The toner TA moves in association with the rotation of the lens 26 in the R-direction.

Figure 15B:
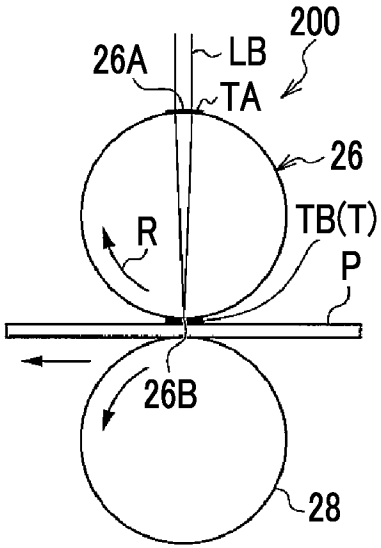

As illustrated in FIG. 15B, when the toner TA reaches the incident portion 26A by the 180-degree rotation of the lens 26, the toner TA scatters or absorbs a part of the light beam LB. Thereby, the intensity of the light beam LB condensed on the contact portion 26B is lowered, and thus a toner TB which is a portion of the toner T is offset on the outer circumferential surface of the lens 26. Since the intensity of the light beam LB of the contact portion 26B is lower in a case where the toner TB is offset than in a case where the toner TA is offset, the amount of offset of the toner TB is increased more than the amount of offset of the toner TA.

Figure 15C:
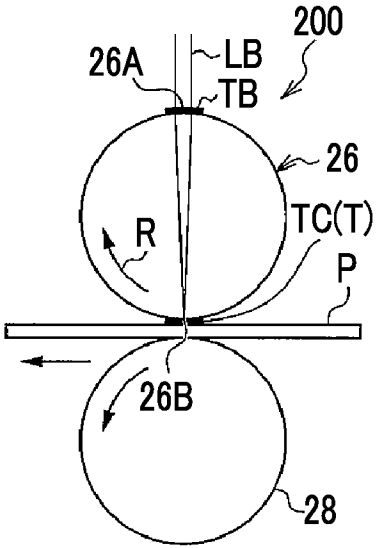

As illustrated in FIG. 15C, when the toner TB reaches the incident portion 26A by 180-degree rotation of the lens 26, the toner TB scatters or absorbs a part of the light beam LB. Thereby, the intensity of the light beam LB condensed on the contact portion 26B is lowered, and thus a toner TC (including the toner TA) which is a portion of the toner T is offset on the outer circumferential surface of the lens 26. Since the intensity of the light beam LB of the contact portion 26B is lower in a case where the toner TC is offset than in a case where the toner TB is offset, the amount of offset of the toner TC is increased more than the amount of offset of the toner TB.

Figure 15D:
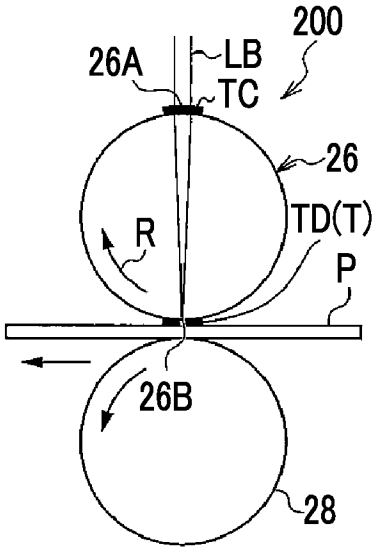

As illustrated in FIG. 15D, when the toner TC reaches the incident portion 26A by the 180-degree rotation of the lens 26, the toner TC scatters or absorbs a part of the light beam LB. Thereby, the intensity of the light beam LB condensed on the contact portion 26B is lowered, and thus a toner TD (including the toner TB) which is a portion of the toner T is offset on the outer circumferential surface of the lens 26. Since the intensity of the light beam LB of the contact portion 26B is lower in a case where the toner TD is offset than in a case where the toner TC is offset, the amount of offset of the toner TD is increased more than the amount of offset of the toner TC. In this manner, in the fixing device 200 according to the comparative example, the offset of the toner T on the lens 26 occurring due to a part of the light beam LB being shielded by the toner T which is offset on the lens 26 increases as the number of times of rotation of the lens 26 increases. In addition, the toners TA, TB, TC, and TD are not likely to be recovered in paper P.

Operations

Next, operations of the first exemplary embodiment will be described.

In the image forming apparatus 10 illustrated in FIG. 1, the toner image G is formed on the paper P by the image forming section 14. The toner image G on the paper P is heated and pressed by the fixing device 20, and is fixed onto the paper P. Meanwhile, in the following description, the illustration and description of the toner image G which is not offset on the outer circumferential surface of the lens 26 (see FIG. 2) will be omitted.

Figure 4A:
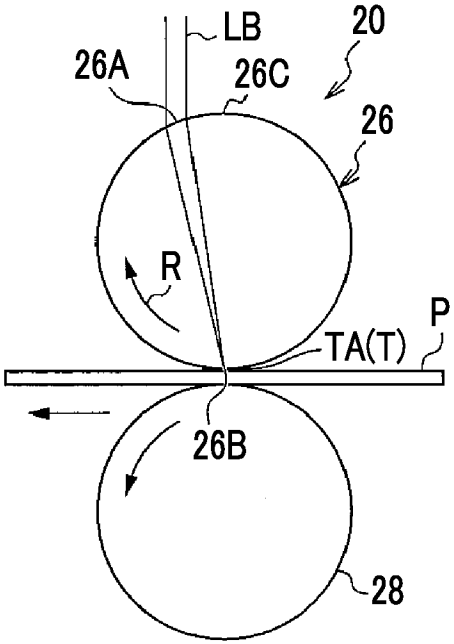
FIGS. 4A to 4C are diagrams illustrating a process until a toner is offset on the lens according to the first exemplary embodiment and then reaches a light incident portion.

As illustrated in FIG. 4A, in the fixing device 20, it is assumed that a toner TA which is a portion of the toner image G (see FIG. 1) is offset on the outer circumferential surface of the lens 26 due to temporary insufficient intensity of the light beam LB. The toner TA is a toner T which is firstly offset (example of a first image forming material), and moves in association with the rotation of the lens 26 in the R-direction. Meanwhile, it is assumed that the width of the toner TA which is offset in the X-direction when the toner is projected on the X-Z plane is equal to or less than W2 (see FIG. 2).

Figure 4B:
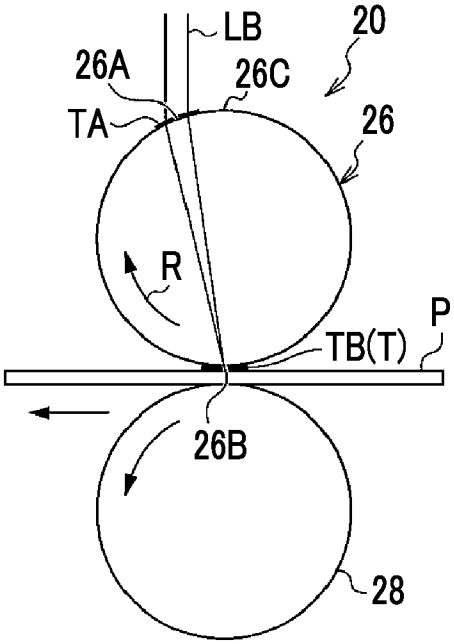

As illustrated in FIG. 4B, when the toner TA is offset and then reaches the incident portion 26A by the rotation of the lens 26, the toner TA scatters or absorbs a part of the light beam LB. Thereby, the intensity of the light beam LB condensed on the contact portion 26B is lowered, and thus a toner TB which is a portion of the toner T and is secondly offset (example of a second image forming material) is offset on the outer circumferential surface of the lens 26 in the contact portion 26B. Meanwhile, since the intensity of the light beam LB reaching the contact portion 26B is lower in a case where the toner TB is offset than in a case where the toner TA is offset, the amount of offset of the toner TB is increased more than the amount of offset of the toner TA.

Figure 4C:
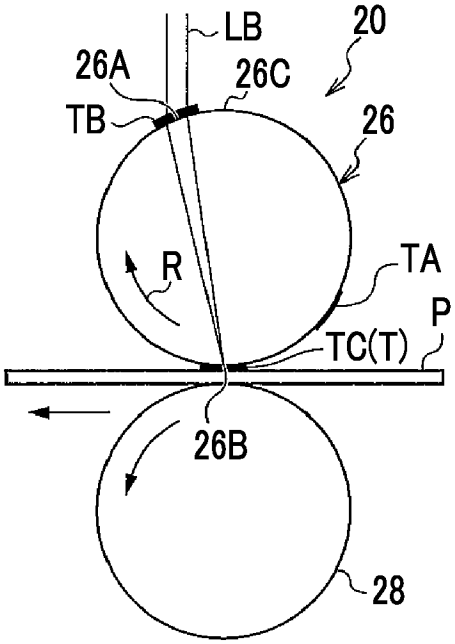

As illustrated in FIG. 4C, when the toner TB reaches the incident portion 26A by the rotation of the lens 26, the toner TB scatters or absorbs a part of the light beam LB. Thereby, the intensity of the light beam LB condensed on the contact portion 26B is further lowered, and thus a toner TC which is a portion of the toner T and is thirdly offset is offset on the outer circumferential surface of the lens 26 in the contact portion 26B. Since the intensity of the light beam LB reaching the contact portion 26B is lower in a case where the toner TC is offset than in a case where the toner TB is offset, the amount of offset of the toner TC is increased more than the amount of offset of the toner TB. At this time, the toner TA is located closer to the upstream side than the contact portion 26B and closer to the downstream side than the toner TB. Meanwhile, the toner TB is an example of a second image forming material with respect to the toner TA, but is an example of a first image forming material with respect to the toner TC. The toner TC is an example of a second image forming material with respect to the toner TB.

Figure 5B:
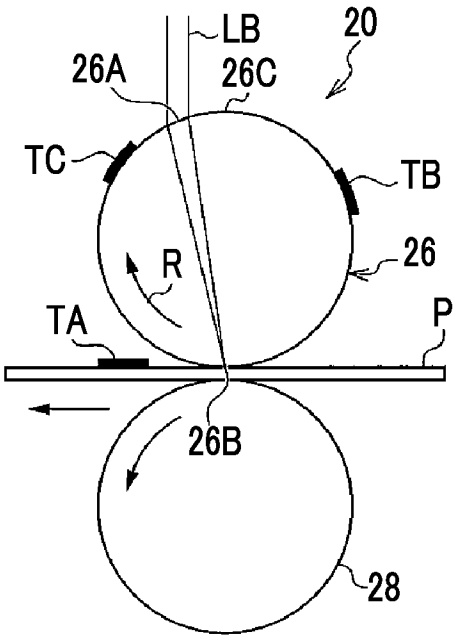
FIGS. 5A and 5B are diagrams illustrating a process until a toner, which is offset on the lens according to the first exemplary embodiment, passes through the light incident portion and is then recovered in paper.
Figure 5A:
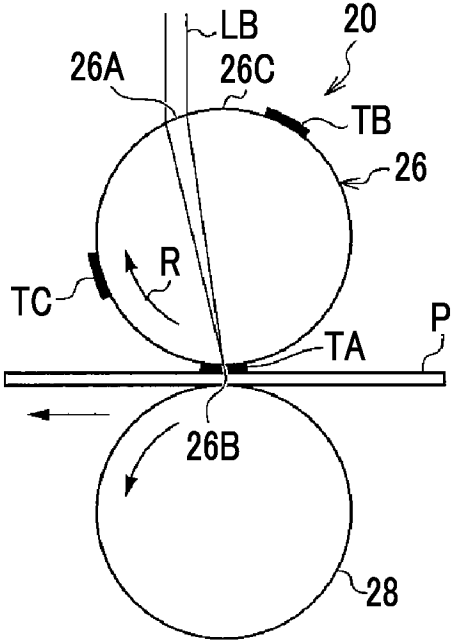

As illustrated in FIG. 5A, when the toner TA which is firstly offset reaches the contact portion 26B by the rotation of the lens 26, the toner TB and the toner TC are not present in the incident portion 26A. This is because the length L2 between the center of the contact portion 26B and the center of the incident portion 26A in the R-direction is different from the length L3 between the center of the incident portion 26A and the center of the contact portion 26B, as described above. In other words, when the toner TA reaches the contact portion 26B, the light beam LB is not scattered or absorbed by the toner TB or the toner TC, and thus energy necessary for fixing onto the paper P is supplied to the toner TA.

As illustrated in FIG. 5B, energy necessary for fixing onto the paper P is supplied to the toner TA, and thus the toner TA which is offset on the lens 26 is fixed onto the paper P. That is, the toner TA is recovered from the outer circumferential surface of the lens 26. For the same reason, when the lens 26 rotates, the toner TB and the toner TC are not located on the light path of the light beam LB again, and thus energy necessary for fixing is supplied to the toner TB or the toner TC when the toner TB or the toner TC reaches the contact portion 26B. Thereby, the toner TB and the toner TC which are offset on the lens 26 are fixed onto the paper P (recovered from the lens 26). Meanwhile, a case where the toner TA is not present on the light path means that the toner TA does not shield any of the light beam LB. In addition, a case where only a portion of the toner TA is present on the light path means that the toner TA shields a part of the light beam LB.

In this manner, in the fixing device 20, even when the toner TB and the toner TC are offset on the lens 26 due to the toner TA being offset on the lens 26, the toner TA, the toner TB, and the toner TC are fixed (recovered) onto the paper P. In other words, it is possible to suppress the toner TA, the toner TB, and the toner TC from remaining on the lens 26 due to insufficient energy. Thereby, in the fixing device 20, it is possible to suppress an increase in the offset of the toner T on the lens 26 occurring due to a part of the light beam LB being shielded by the toner TA which is offset on the lens 26, compared to the comparative example described above. In other words, it is possible to suppress an increase in the toner TA which is further attached to the toner TA attached to the lens 26.

In addition, in the fixing device 20, the collimator lens 24 causes at least a part of the light beam LB from the laser array 22 to be incident on a side which is closer to the downstream side than the contact portion 26B and is closer to the upstream side than the facing portion 26C in the R-direction. For this reason, the toner TB which is secondly offset and the toner TC which is thirdly offset are not likely to be disposed on the optical axis K (light path) of the light beam LB, compared to a configuration in which the light beam LB is incident on a side which is closer to the upstream side than the contact portion 26B and is closer to the downstream side than the facing portion 26C. Thereby, it is possible to suppress an increase in the offset of the toner T on the lens 26 occurring due to a part of the light beam LB being shielded by the toner TA which is offset on the lens 26, compared to the comparative example described above.

Further, as illustrated in FIG. 2, in the fixing device 20, the light beam LB is incident on only a portion (incident portion 26A) except for the facing portion 26C in the outer circumferential surface of the lens 26. For this reason, it is possible to suppress the toner T from being attached to the lens 26 for every 180 degrees, compared to a configuration in which the light beam LB is incident not only on a portion different from the facing portion 26C but also on the facing portion 26C. In other words, it is possible to suppress the toner T from being attached to a specific position of the outer circumferential surface of the lens 26 in a biased manner.

In the image forming apparatus 10 illustrated in FIG. 1, an increase in the offset of the toner T on the lens 26 in the fixing device 20 illustrated in FIG. 2 is suppressed, and thus image staining (image defect) occurring due to the increase in the toner T which is offset on the lens 26 is suppressed.

Meanwhile, if the light beam LB is cased to be incident on portions of the lens 26 for every 120 degrees in the R-direction based on the central position of the contact portion 26B in the R-direction, there is the possibility of the attachment of the toner T to the lens 26 increasing, and thus it is preferable to cause the light beam LB to be incident on a portion other than the portion of the lens 26 having an angle of 120 degrees in the R-direction. In addition, it is difficult to cause the light beam LB to be incident on a portion of the lens 26 having an angle of equal to or less than 90 degrees in the R-direction and a portion having an angle of equal to or greater than 270 degrees, and thus it is preferable to cause the light beam LB to be incident on a portion other than the portion.

Second Exemplary Embodiment

Next, examples of a fixing device and an image forming apparatus according to a second exemplary embodiment will be described. Meanwhile, members and portions which are basically the same as those in the first exemplary embodiment described above are denoted by the same reference numerals and signs as those in the first exemplary embodiment, and a description thereof will be omitted here.

Figure 6:
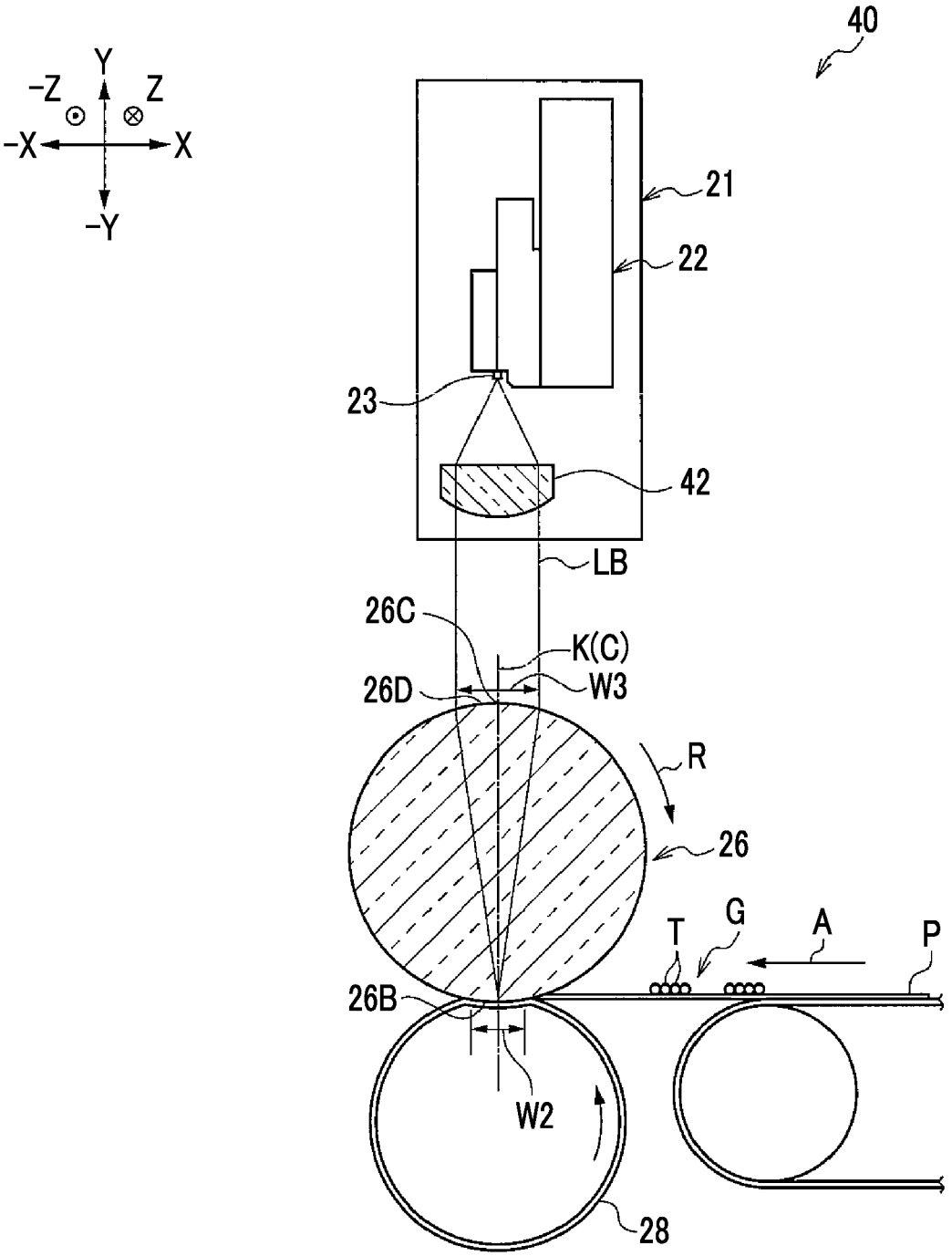
FIG. 6 is a configuration diagram illustrating a fixing device according to a second exemplary embodiment.

FIG. 6 illustrates a fixing device 40 according to the second exemplary embodiment. In the fixing device 40, a collimator lens 42 as an example of an incidence unit is provided instead of the collimator lens 24 in the fixing device 20 (see FIG. 2) according to the first exemplary embodiment. Meanwhile, in the fixing device 40, the other members except for the collimator lens 42 have the same configurations as those of the fixing device 20.

Collimator Lens

The collimator lens 42 is a plano-convex lens that changes a light beam LB emitted from a laser light source 23 into parallel light. In addition, the shape and arrangement of the collimator lens 42 are set so that at least a part of the light beam LB from a laser array 22 is incident on a portion of a lens 26 (shifted from a facing portion 26C in the R-direction) which is different from the facing portion 26C. Further, the collimator lens 42 is disposed so as to cause the light beam LB to be incident on an incident portion of the lens 26 which includes the facing portion 26C. In other words, in the second exemplary embodiment, the positions of an optical axis K and an axis C in the X-direction are substantially the same as each other when seen in the Z-direction.

Although described later in detail, the collimator lens 42 is disposed at a position where toners T which are secondly and thirdly offset on the lens 26 do not shield at least a part of the light beam LB directed to the toner T which is firstly offset, by the firstly offset toner T on the lens 26 shielding the light beam LB. Here, a portion of the lens 26 on which the light beam LB from the collimator lens 42 is incident is referred to as an incident portion 26D. The incident portion 26D includes the incident portion 26A (see FIG. 2) according to the first exemplary embodiment and the facing portion 26C. The position of the collimator lens 42 in the Y-direction is adjusted so that the width of the incident portion 26D of the lens 26 in the X-direction when the incident portion is projected on the X-Z plane is set to be W3 when seen in the Z-direction.

The width W3 when the incident portion 26D is projected on the X-Z plane is larger than a width W2 when a contact portion 26B is projected on the X-Z plane. In other words, when the toner T, which is offset with the width W2 in the X-direction in the contact portion 26B, reaches the incident portion 26D, a part of the light beam LB incident on the incident portion 26D is not shielded by the offset toner T.

Operations

Next, operations of the second exemplary embodiment will be described.

Figure 7A:
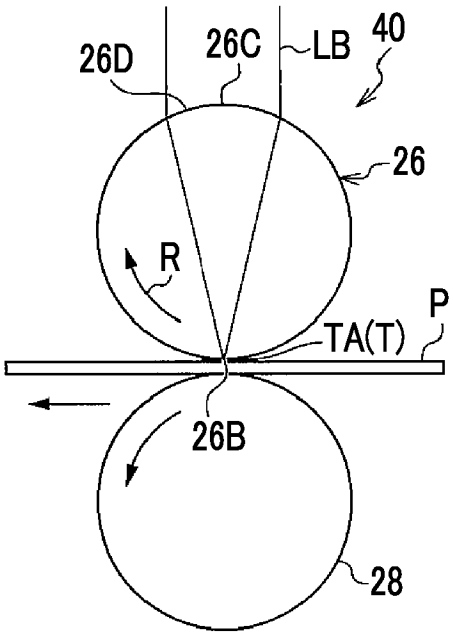
FIGS. 7A to 7C are diagrams illustrating a process until a toner is offset on a lens according to the second exemplary embodiment and is then recovered in paper.

As illustrated in FIG. 7A, in the fixing device 40, it is assumed that a toner TA is offset on the outer circumferential surface of the lens 26 due to temporary insufficient intensity of the light beam LB. The toner TA moves in association with the rotation of the lens 26 in the R-direction. Meanwhile, it is assumed that the width of the toner TA which is offset in the X-direction when the toner is projected on the X-Z plane is equal to or less than W2 (see FIG. 6).

Figure 7B:
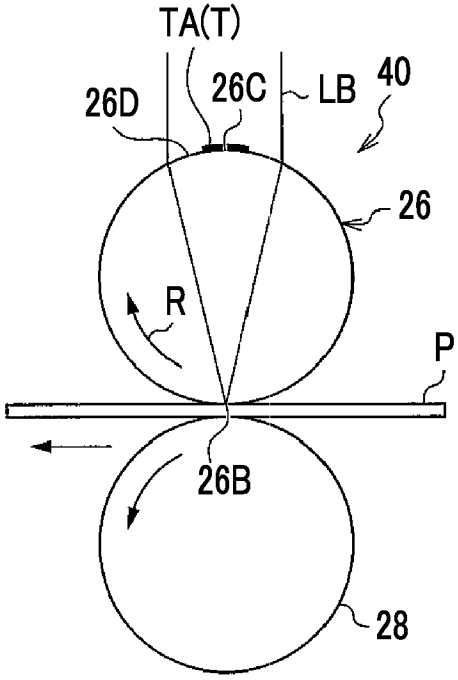

As illustrated in FIG. 7B, when the toner TA is offset and then reaches the incident portion 26D by the rotation of the lens 26 by 180 degrees, the toner TA scatters or absorbs a part of the light beam LB from a light irradiation section 21 (see FIG. 6). Here, since the width of the incident portion 26D in the X-direction is larger than the width of the toner TA in the X-direction, the light beam LB having passed through a region having the toner TA not attached thereto is condensed on (illuminated to) the contact portion 26B even when the toner TA scatters or absorbs a part of the light beam LB. For this reason, it is possible to suppress the intensity of the light beam LB condensed on the contact portion 26B from being extremely lowered, and thus a toner, not shown in the drawing, which has entered the contact portion 26B is heated by the light beam LB and is fixed onto paper P. Thereby, it is possible to suppress the second and subsequent offset of the toner T from occurring due to the toner TA which is firstly offset.

Figure 7C:
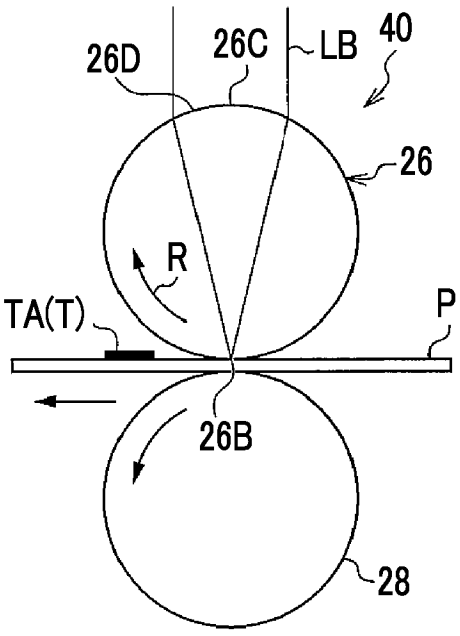

As illustrated in FIG. 7C, when the toner TA which is firstly offset reaches the contact portion 26B by the 180-degree rotation of the lens 26, other toners T are hardly present in the incident portion 26D. In other words, when the toner TA reaches the contact portion 26B, the light beam LB is not scattered or absorbed by the other toners T, energy necessary for fixing onto the paper P is supplied to the toner TA. Thereby, the toner TA is fixed onto the paper P. Meanwhile, in FIG. 7C, the toner TA is illustrated at a position having passed through the contact portion 26B.

In this manner, in the fixing device 40, even when the toner TA is offset on the lens 26, the toner TA is fixed (recovered) onto the paper P. In other words, the second and subsequent offset of the toner T is suppressed. Thereby, in the fixing device 40, it is possible to suppress an increase in the offset of the toner T on the lens 26 occurring due to apart of the light beam LB being shielded by the toner TA which is offset on the lens 26, compared to the comparative example described above. In other words, it is possible to suppress an increase in the toner TA which is further attached to the toner TA attached to the lens 26.

In addition, as illustrated in FIG. 6, in the fixing device 40, the light beam LB is incident on the incident portion of the lens 26 which includes the facing portion 26C, and the positions of the optical axis K and the axis C are substantially the same as each other. Thereby, the position of the collimator lens 42 with respect to the axis C in the X-direction may be adjusted by a small amount, compared to a configuration in which the light beam LB is incident on only a portion except for the facing portion 26C.

Further, in the image forming apparatus 10 (see FIG. 1) including the fixing device 40, an increase in the offset of the toner T on the lens 26 in the fixing device 40 is suppressed, and thus image staining (image defect) occurring due to the increase in the toner T which is offset on the lens 26 is suppressed.

Third Exemplary Embodiment

Next, examples of a fixing device and an image forming apparatus according to a third exemplary embodiment will be described. Meanwhile, members and portions which are basically the same as those in the first and second exemplary embodiment described above are denoted by the same reference numerals and signs as those in the first and second exemplary embodiments, and a description thereof will be omitted here.

Figure 8:
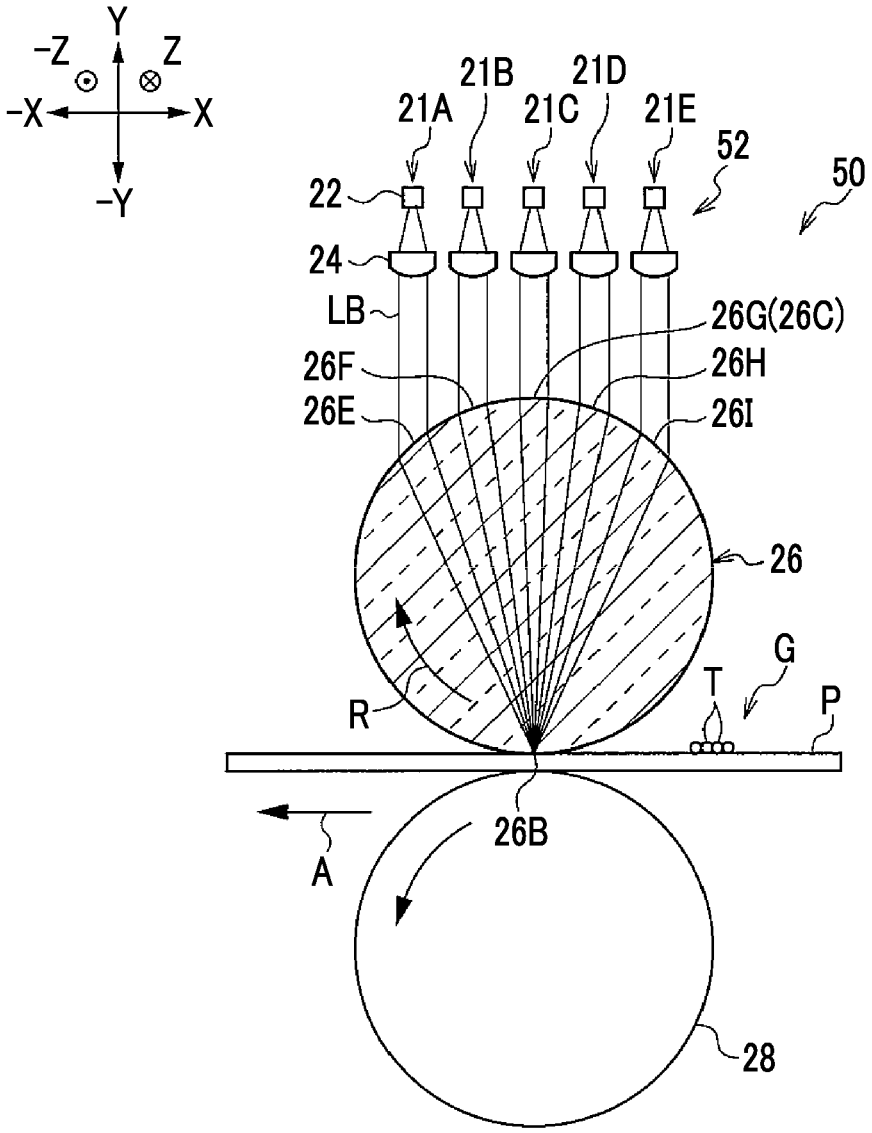
FIG. 8 is a configuration diagram illustrating a fixing device according to a third exemplary embodiment.

FIG. 8 illustrates a fixing device 50 according to the third exemplary embodiment. In the fixing device 50, a light irradiation section 52 is provided instead of the light irradiation section 21 (see FIG. 2) in the fixing device 20 (see FIG. 2) according to the first exemplary embodiment. Meanwhile, in the fixing device 50, the other members except for a light irradiation section 52 have the same configurations as those of the fixing device 20.

As an example, the light irradiation section 52 includes irradiation sections 21A, 21B, 21C, 21D, and 21E. Each of the irradiation sections 21A, 21B, 21C, 21D, and 21E has the same configuration as that of the light irradiation section 21 according to the first exemplary embodiment, and includes a laser array 22 and a collimator lens 24.

Here, incidence portions of a light beam LB from the irradiation sections 21A, 21B, 21C, 21D, and 21E in the outer circumferential surface of a lens 26 are referred to as incident portions 26E, 26F, 26G, 26H, and 26I, respectively. The incident portions 26E, 26F, 26G, 26H, and 26I are disposed at intervals in the R-direction in this order from the upstream side in the R-direction on aside opposite to a contact portion 26B in the outer circumferential surface of the lens 26. That is, in the fixing device 50, the light beam LB is incident on plural locations (as an example, five locations) of the lens 26 in the circumferential direction using the plural laser arrays 22 and plural collimator lenses 24.

As an example, the widths of the incident portions 26E, 26F, 26G, 26H, and 26I in the X-direction when the incident portions are projected on the X-Z plane are substantially the same as each other. Meanwhile, the incident portion 26G includes a facing portion 26C. In addition, all of the light beams LB incident on the incident portions 26E, 26F, 26G, 26H, and 26I are condensed on the contact portion 26B. Further, the sum of widths of the incident portions 26F, 26G, and 26H in the X-direction is larger than a width W2 (see FIG. 2) in the X-direction in the contact portion 26B.

Operations

Next, operations of the third exemplary embodiment will be described.

Figure 9A:
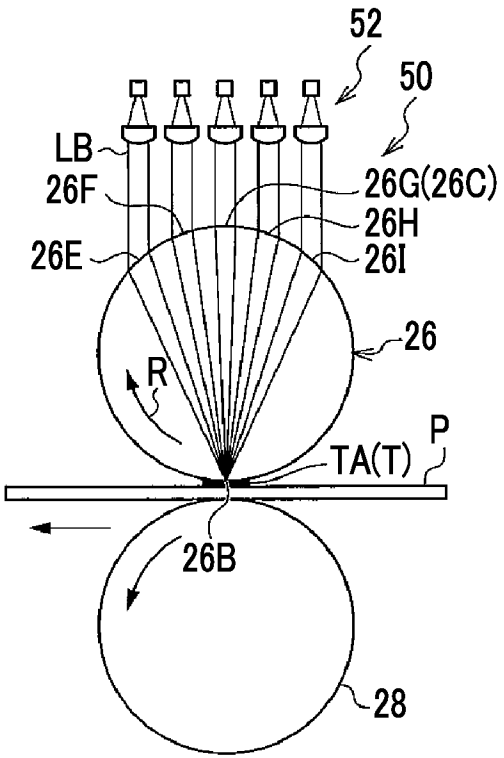
FIGS. 9A to 9C are diagrams illustrating a process until a toner is offset on a lens according to the third exemplary embodiment and is then recovered in paper.

As illustrated in FIG. 9A, in the fixing device 50, it is assumed that a toner TA is offset on the outer circumferential surface of the lens 26 due to temporary insufficient intensity of the light beam LB. The toner TA moves in association with the rotation of the lens 26 in the R-direction. Meanwhile, it is assumed that the width of the toner TA which is offset in the X-direction when the toner is projected on the X-Z plane (see FIG. 8) is equal to or less than W2 (see FIG. 6).

Figure 9B:
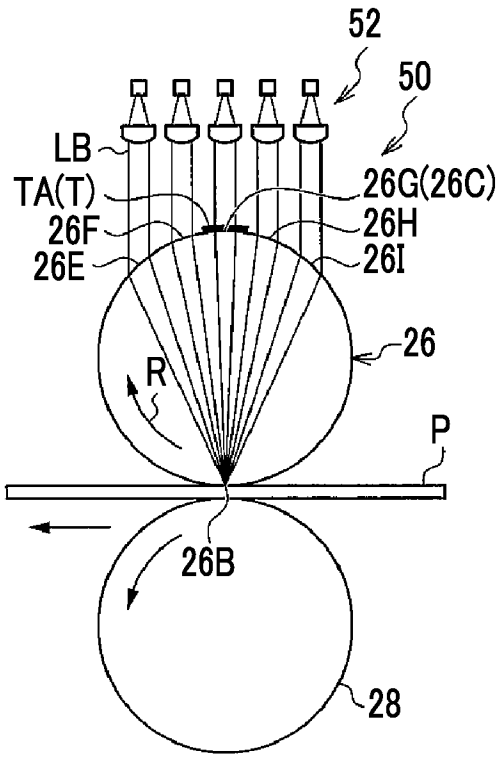

As illustrated in FIG. 9B, when the toner TA is offset and then reaches any one of the incident portions 26E, 26F, 26G, 26H, and 26I by the 180-degree rotation of the lens 26, the toner TA scatters or absorbs a part of the light beam LB from the light irradiation section 52. Here, since the sum of widths of the incident portions 26E, 26F, 26G, 26H, and 26I in the X-direction is larger than the width of the toner TA in the X-direction, the light beam LB having passed through a region having the toner TA not attached thereto is condensed on (illuminated to) the contact portion 26B even when the toner TA scatters or absorbs a part of the light beam LB. For this reason, it is possible to suppress the intensity of the light beam LB condensed on the contact portion 26B from being extremely lowered, and thus a toner, not shown in the drawing, which has entered the contact portion 26B is heated by the light beam LB and is fixed onto paper P. Thereby, it is possible to suppress the second and subsequent offset of a toner T from occurring due to the toner TA which is firstly offset.

Figure 9C:
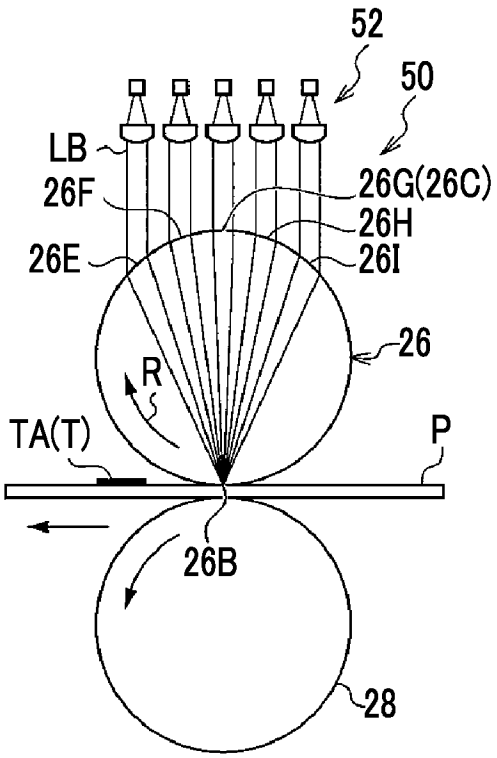

As illustrated in FIG. 9C, when the toner TA which is firstly offset reaches the contact portion 26B by the 180-degree rotation of the lens 26, other toners T are not present in the incident portion 26D. In other words, when the toner TA reaches the contact portion 26B, the light beam LB is not scattered or absorbed by the other toners T, energy necessary for fixing onto the paper P is supplied to the toner TA. Thereby, the toner TA is fixed onto the paper P. Meanwhile, in FIG. 9C, the toner TA is illustrated at a position having passed through the contact portion 26B.

In this manner, in the fixing device 50, even when the toner TA is offset on the lens 26, the toner TA is fixed (recovered) onto the paper P. Thereby, in the fixing device 50, it is possible to suppress an increase in the offset of the toner T on the lens 26 occurring due to a part of the light beam LB being shielded by the toner TA which is offset on the lens 26, compared to the comparative example described above. In other words, it is possible to suppress an increase in the toner TA which is further attached to the toner TA attached to the lens 26.

In addition, as illustrated in FIG. 8, in the fixing device 50, the light beam LB is incident on plural locations (as an example, five locations) of the lens 26 in the R-direction, including a facing portion 26C. For this reason, the amount of light beam LB incident on a region in which the toner TA is not present in the outer circumferential surface of the lens 26 increases, compared to a configuration in which the light beam LB is incident on only one location of the lens 26 in the R-direction. Thereby, even when the width of the contact portion 26B in the X-direction is large and the width of the toner T which is firstly offset on the lens 26 is large, energy necessary for fixing onto the paper P is supplied to the toner T, and thus an increase in the offset of the toner T on the lens 26 is suppressed.

Further, in the image forming apparatus 10 (see FIG. 1) including the fixing device 50, an increase in the offset of the toner T on the lens 26 in the fixing device 50 is suppressed, and thus image staining (image defect) occurring due to the increase in the toner T which is offset on the lens 26 is suppressed.

Fourth Exemplary Embodiment

Next, examples of a fixing device and an image forming apparatus according to a fourth exemplary embodiment will be described. Meanwhile, members and portions which are basically the same as those in the first, second, and third exemplary embodiments described above are denoted by the same reference numerals and signs as those in the first to third exemplary embodiments, and a description thereof will be omitted here.

Figure 10:
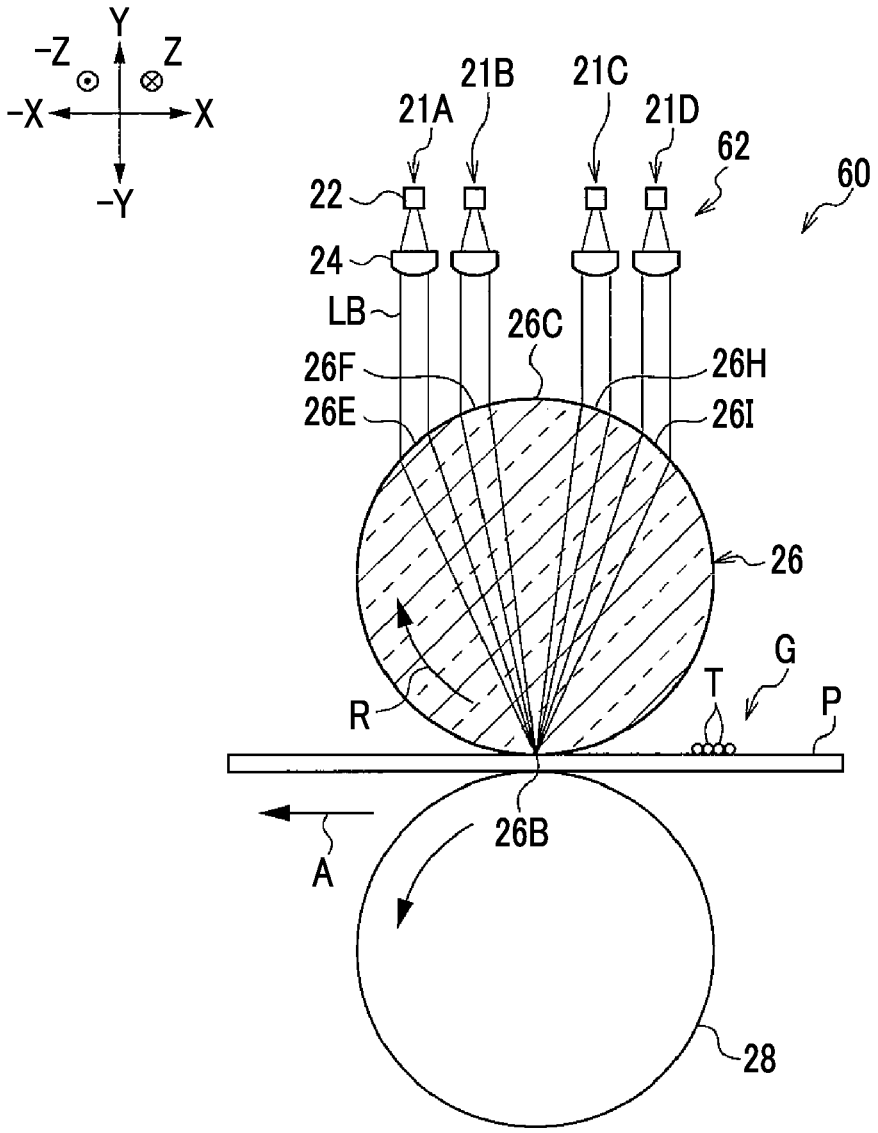
FIG. 10 is a configuration diagram illustrating a fixing device according to a fourth exemplary embodiment.

FIG. 10 illustrates a fixing device 60 according to the fourth exemplary embodiment. The fixing device 60 is configured such that the incident portion 26G (see FIG. 8) in the fixing device 50 (see FIG. 8) according to the third exemplary embodiment is removed. Meanwhile, in the fixing device 60, the other portions and members except for the incident portion 26G have the same configurations as those of the fixing device 50.

Operations

Next, operations of the fourth exemplary embodiment will be described.

Figure 11A:
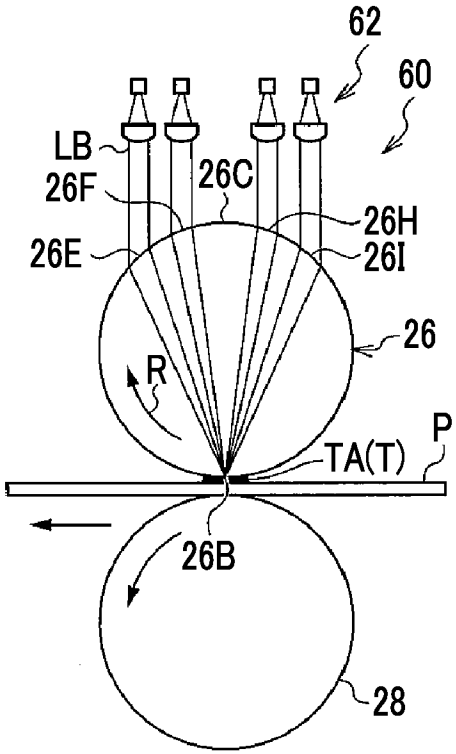
FIGS. 11A to 11C are diagrams illustrating a process until a toner is offset on a lens according to the fourth exemplary embodiment and is then recovered in paper.

As illustrated in FIG. 11A, in the fixing device 60, it is assumed that a toner TA is offset on the outer circumferential surface of the lens 26 due to temporary insufficient intensity of the light beam LB. The toner TA moves in association with the rotation of the lens 26 in the R-direction. Meanwhile, it is assumed that the width of the toner TA which is offset in the X-direction when the toner is projected on the X-Z plane is equal to or less than W2 (see FIG. 6).

Figure 11B:
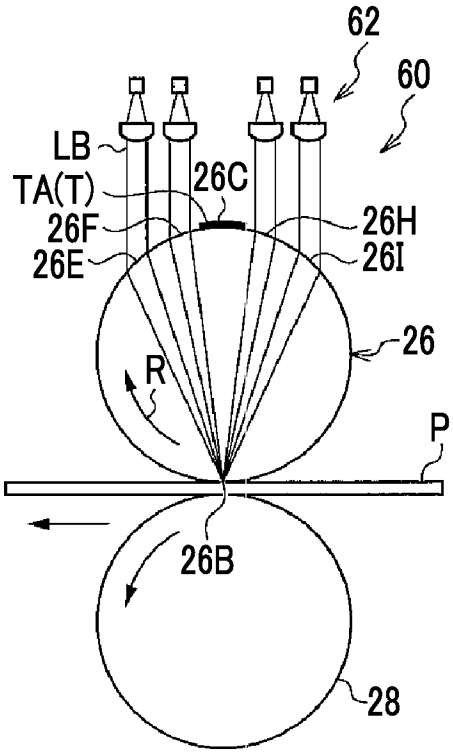

As illustrated in FIG. 11B, when the toner TA is offset and then reaches any one of the incident portions 26E, 26F, 26H, and 26I by the 180-degree rotation of the lens 26, the toner TA scatters or absorbs apart of the light beam LB. Here, since the sum of widths of the incident portions 26E, 26F, 26H, and 26I in the X-direction is larger than the width of the toner TA in the X-direction, the light beam LB having passed through a region having the toner TA not attached thereto is condensed on (illuminated to) the contact portion 26B even when the toner TA scatters or absorbs a part of the light beam LB. For this reason, it is possible to suppress the intensity of the light beam LB condensed on the contact portion 26B from being extremely lowered, and thus a toner, not shown in the drawing, which has entered the contact portion 26B is heated by the light beam LB and is fixed onto paper P. Thereby, it is possible to suppress the second and subsequent offset of a toner T from occurring due to the toner TA which is firstly offset.

Figure 11C:
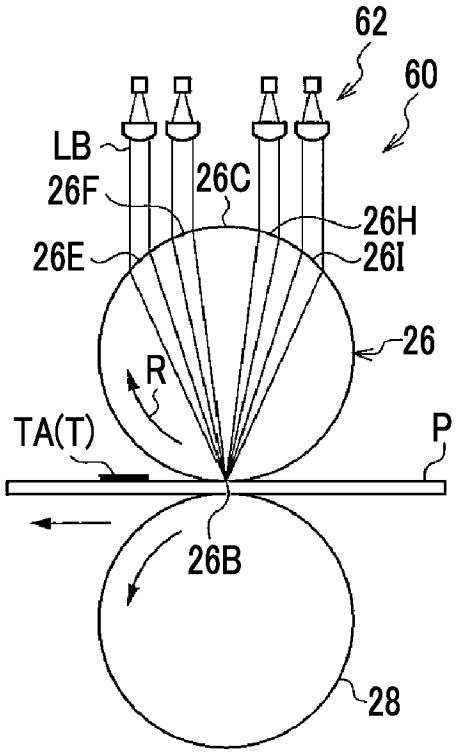

As illustrated in FIG. 11C, when the toner TA which is firstly offset reaches the contact portion 26B by the 180-degree rotation of the lens 26, other toners T are not present in the incident portion 26D. In other words, when the toner TA reaches the contact portion 26B, the light beam LB is not scattered or absorbed by the other toners T, energy necessary for fixing onto the paper P is supplied to the toner TA. Thereby, the toner TA is fixed onto the paper P. Meanwhile, in FIG. 11C, the toner TA is illustrated at a position having passed through the contact portion 26B.

In this manner, in the fixing device 60, even when the toner TA is offset on the lens 26, the toner TA is fixed (recovered) onto the paper P. Thereby, in the fixing device 60, it is possible to suppress an increase in the offset of the toner T on the lens 26 occurring due to a part of the light beam LB being shielded by the toner TA which is offset on the lens 26, compared to the comparative example described above. In other words, it is possible to suppress an increase in the toner TA which is further attached to the toner TA attached to the lens 26.

In addition, in the fixing device 60 illustrated in FIG. 10, the light beam LB is incident on only portions (incident portions 26E, 26F, 26H, and 26I) except for the facing portion 26C in the outer circumferential surface of the lens 26. For this reason, it is possible to suppressed the toner T from being attached to the lens 26 for every 180 degrees, compared to a configuration in which the light beam LB is incident not only on a portion different from the facing portion 26C but also on the facing portion 26C. In other words, it is possible to suppress the toner T from being attached to a specific position of the outer circumferential surface of the lens 26 in a biased manner.

Further, in the fixing device 60, the light beam LB is incident on plural locations (as an example, five locations) of the lens 26 in the R-direction, exclusive of the facing portion 26C. For this reason, the amount of light beam LB incident on a region in which the toner TA is not present in the outer circumferential surface of the lens 26 increases, compared to a configuration in which the light beam LB is incident on only one location of the lens 26 in the R-direction. Thereby, even when the width of the contact portion 26B in the X-direction is large and the width of the toner T which is firstly offset on the lens 26 is large, energy necessary for fixing onto the paper P is supplied to the toner T, and thus an increase in the offset of the toner T on the lens 26 is suppressed.

In addition, in the image forming apparatus 10 (see FIG. 1) including the fixing device 60, an increase in the offset of the toner T on the lens 26 in the fixing device 60 is suppressed, and thus image staining (image defect) occurring due to the increase in the toner T which is offset on the lens 26 is suppressed.

Fifth Exemplary Embodiment

Next, examples of a fixing device and an image forming apparatus according to a fifth exemplary embodiment will be described. Meanwhile, members and portions which are basically the same as those in the first exemplary embodiment described above are denoted by the same reference numerals and signs as those in the first exemplary embodiment, and a description thereof will be omitted here.

Figure 12:
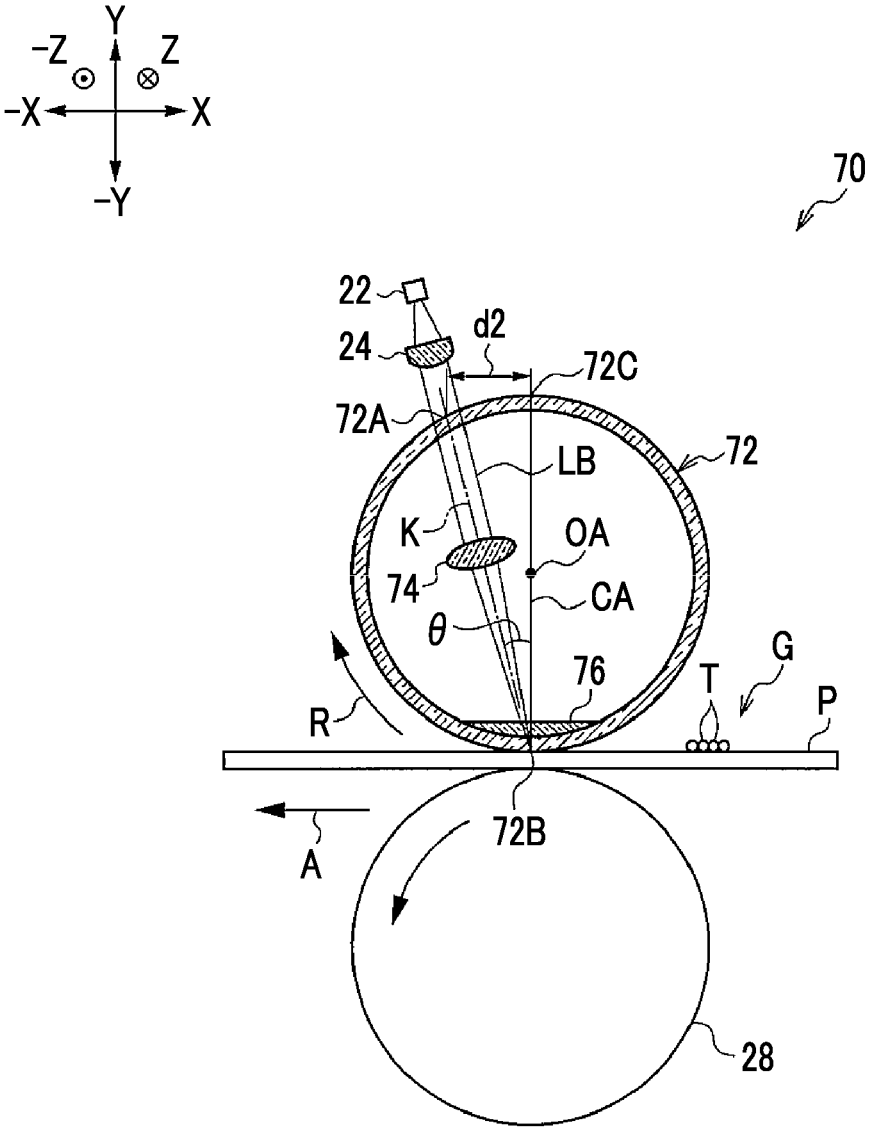
FIG. 12 is a configuration diagram illustrating a fixing device according to a fifth exemplary embodiment.

FIG. 12 illustrates a fixing device 70 according to the fifth exemplary embodiment. The fixing device 70 includes a laser array 22, a transparent tube 72 as an example of a contact member, a collimator lens 24, and a facing roller 28. Further, the fixing device 70 includes a condensing lens 74 and a transparent pad 76. Meanwhile, in the fifth exemplary embodiment, the direction of an optical axis K of the laser array 22 to be described later is different from the Y-direction. In addition, an A-direction is along the X-direction.

Transparent Tube

As an example, the transparent tube 72 is formed to have a cylindrical shape (to be hollow) when seen in the Z-direction which is a rotation axis direction. In addition, the transparent tube 72 is an optical member that transmits a light beam LB having passed through the collimator lens 24. Further, the transparent tube 72 includes a base material layer for maintaining necessary intensity, an elastic layer laminated on the base material layer, and a release layer laminated on the elastic layer. The base material layer, the elastic layer, and the release layer are not shown in the drawing. Meanwhile, the transparent tube 72 is not limited to a three-layered structure.

As an example, a cap material, not shown in the drawing, is attached to both ends of the transparent tube 72 in the Z-direction. The transparent tube 72 is interposed between the transparent pad 76 to be described later and the facing roller 28, and is configured to transport paper P interposed between the transparent tube and the facing roller 28 by a gear, provided in one cap material, being rotated by a motor. Meanwhile, a rotation direction of the transparent tube 72 is also referred to as the R-direction.

The term "transparent" in the transparent tube 72 means that transmittance in a wavelength region of the light beam LB is sufficiently high. That is, the transparent tube 72 may be a tube transmitting the light beam LB, and the higher the transmittance, the better. The transmittance may be, for example, equal to or higher than 90 [%], preferably, equal to or higher than 95 [%].

A portion on which the light beam LB is incident from the collimator lens 24 in the outer circumferential surface of the transparent tube 72 is referred to as an incident portion 72A. In addition, an axis that passes through a center OA of the transparent tube 72 in the X-Y cross-section and is perpendicular to the Y-direction is referred to as an axis CA. Here, the optical axis K of the light beam LB intersects the axis CA at an angle θ (θ is an acute angle). In addition, the center of the incident portion 72A in the R-direction is set at a position separated from the axis CA in the X-direction by a distance d2. Although not shown in the drawing, the width of the incident portion 72A in the X-direction when the incident portion is projected on an X-Z plane is set to be W1 (see FIG. 2) similar to the first exemplary embodiment.

On the other hand, in the outer circumferential surface of the transparent tube 72, a portion on which the light beam LB incident from the incident portion 72A is condensed (which is illuminated with the light beam LB), which comes into contact with a toner T on the paper P, and at which the toner T on the paper P is heated by the light beam LB is referred to as a contact portion 72B. The contact portion 72B is a portion equivalent to a nip portion where the outer circumferential surface of the transparent tube 72 comes into contact with the outer circumferential surface of the facing roller 28 in a state where there is no paper P. In addition, the center of the contact portion 72B in the R-direction is located on the axis CA. As an example, the width of the contact portion 72B in the X-direction is set to be larger than the width of the incident portion 72A in the X-direction.

In addition, a portion shifted from the contact portion 72B by 180 degrees in the R-direction in the outer circumferential surface of the transparent tube 72 is referred to as a facing portion 72C. Here, the contact portion 72B and the facing portion 72C are located on the axis CA. In other words, the incident portion 72A is a portion shifted from the facing portion 72C by the distance d2 in the X-direction. In FIG. 12, the light beam LB incident on the transparent tube 72 is schematically illustrated so as to be condensed on one point in the contact portion 72B, but the light beam LB is actually set to be in a condensing state in which the light beam has a width in the R-direction in the contact portion 72B.

Condensing Lens

The condensing lens 74 is supported by a supporting frame (not shown) inside the transparent tube 72, and is disposed between the incident portion 72A on the optical axis K of the light beam LB and the transparent pad 76. In addition, the condensing lens 74 is configured to condense the light beam LB on the contact portion 72B.

Transparent Pad

The transparent pad 76 has a cross-section protruding on the −Y side when seen in the Z-direction with the Z-direction as a longitudinal direction. A curved portion (convex-shaped portion) of the transparent pad 76 contacts with the inner surface of the transparent tube 72. The transparent pad 76 supports the transparent tube 72 from the inner side in the vicinity of the contact portion 72B. Meanwhile, an optical power of the transparent pad 76 is lower than an optical power of the condensing lens 74, and thus a description of the optical power of the transparent pad 76 will be omitted in the present exemplary embodiment. This is because when the optical power is regarded as a condensing power of the light beam LB, the optical power of the transparent pad 76 is at a negligible level, compared to the optical power of the condensing lens 74.

Collimator Lens

The collimator lens 24 is disposed at a position where toners T which are secondly and thirdly offset on the transparent tube 72 do not shield the light beam LB directed to the toner T which is firstly offset, by the firstly offset toner T on the transparent tube 72 shielding at least a part of the light beam LB. In other words, the collimator lens 24 causes at least a part of the light beam LB to be incident on the transparent tube 72 at a portion different from the facing portion 72C.

Although not shown in the drawing, the length of the outer circumferential surface of the transparent tube 72 is set to be L4, the length of an arc between the central position of the contact portion 72B in the R-direction and the central position of the incident portion 72A in the R-direction is set to be L5, and the length of an arc between the central position of the incident portion 72A in the R-direction and the central position of the contact portion 72B in the R-direction is set to be L6. The relation of L4=L5+L6 is established. In addition, the relation of L5<L6 is established. Here, it is assumed that the toner T which is offset on the transparent tube 72 illustrated in FIG. 12 is transferred to the paper P when the transparent tube 72 makes one rotation. In this case, the relation of L5<L6 is established, the (offset) toners T which are once disposed at the incident portion 72A and the contact portion 72B on a light path of the light beam LB are not located on the light path of the light beam LB again when the transparent tube 72 rotates.

Here, in the fixing device 70, the optical axis K is shifted in the X-direction with respect to the axis CA as described above, and thus the position of the laser array 22, the central position (incidence position) of the incident portion 72A, and the central position (irradiation position) of the contact portion 72B are not arranged on the same straight line when seen in the Z direction. In other words, the collimator lens 24 causes the light beam LB to be incident on the transparent tube 72 so that an incidence position and an irradiation position do not face each other at an angle of 180 degrees in the circumferential direction of the transparent tube 72.

Operations

Next, operations of the fifth exemplary embodiment will be described.

In the fixing device 70 illustrated in FIG. 12, a toner image G on the paper P is heated and pressed, and is fixed onto the paper P. Meanwhile, in the following description, the illustration and description of the toner image G which is not offset on the outer circumferential surface of the transparent tube 72 will be omitted.

Figure 13A:
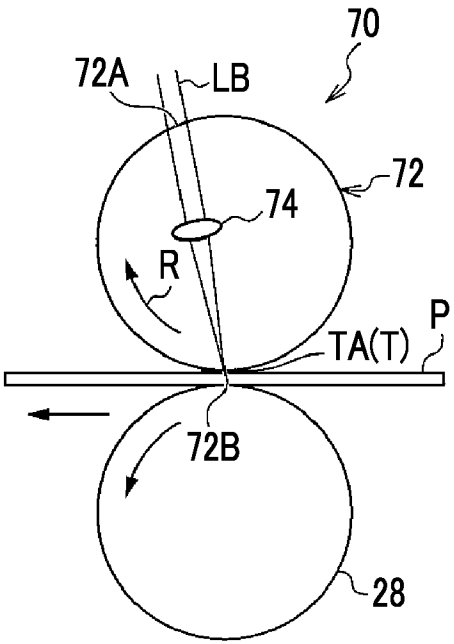
FIGS. 13A to 13C are diagrams illustrating a process until a toner is offset on a lens according to the fifth exemplary embodiment and then reaches alight incident portion.

As illustrated in FIG. 13A, in the fixing device 70, it is assumed that a toner TA which is a portion of the toner image G (see FIG. 12) is offset on the outer circumferential surface of the transparent tube 72 due to temporary insufficient intensity of the light beam LB. The toner TA is a toner T which is firstly offset (example of a first image forming material), and moves in association with the rotation of the transparent tube 72 in the R-direction. Meanwhile, it is assumed that the width of the toner TA which is offset in the X-direction is equal to or smaller than the width of the contact portion 72B in the X-direction.

Figure 13B:
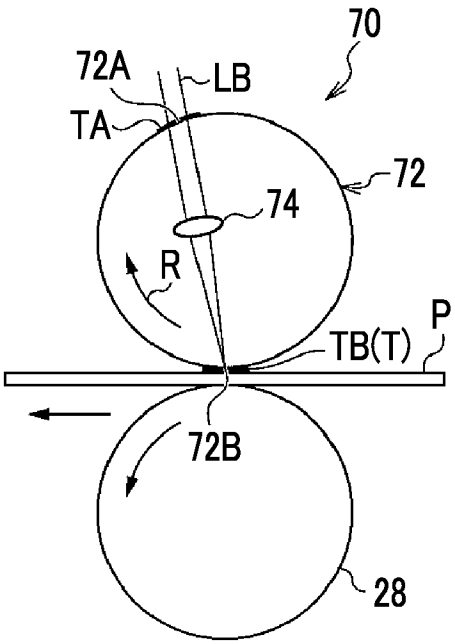

As illustrated in FIG. 13B, when the toner TA is offset and then reaches the incident portion 72A by the rotation of the transparent tube 72, the toner TA scatters or absorbs a part of the light beam LB. Thereby, the intensity of the light beam LB condensed on the contact portion 72B is lowered, and thus a toner TB which is a portion of the toner T and is secondly offset (example of a second image forming material) is offset on the outer circumferential surface of the transparent tube 72 in the contact portion 72B. Meanwhile, since the intensity of the light beam LB reaching the contact portion 72B is lower in a case where the toner TB is offset than in a case where the toner TA is offset, the amount of offset of the toner TB is increased more than the amount of offset of the toner TA.

Figure 13C:
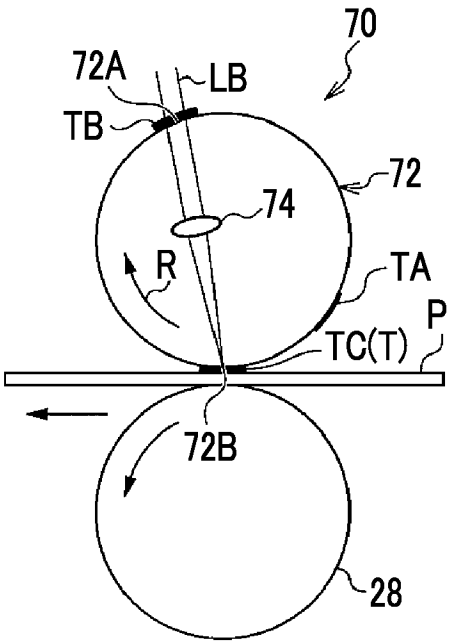

As illustrated in FIG. 13C, when the toner TB reaches the incident portion 72A by the rotation of the transparent tube 72, the toner TB scatters or absorbs a part of the light beam LB. Thereby, the intensity of the light beam LB condensed on the contact portion 72B is further lowered, and thus a toner TC which is a portion of the toner T and is thirdly offset is offset on the outer circumferential surface of the transparent tube 72 in the contact portion 72B. Since the intensity of the light beam LB reaching the contact portion 72B is lower in a case where the toner TC is offset than in a case where the toner TB is offset, the amount of offset of the toner TC is increased more than the amount of offset of the toner TB. At this time, the toner TA is located closer to the upstream side than the contact portion 72B and closer to the downstream side than the toner TB. Meanwhile, the toner TB is an example of a second image forming material with respect to the toner TA, but is an example of a first image forming material with respect to the toner TC. The toner TC is an example of a second image forming material with respect to the toner TB.

Figure 14B:
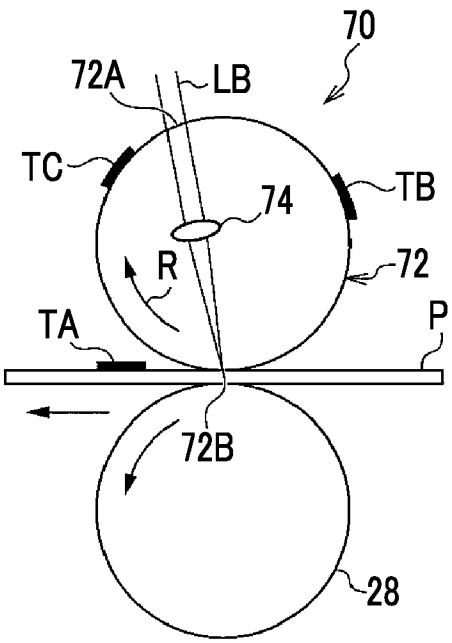
FIGS. 14A and 14B are diagrams illustrating a process until the toner, which is offset on the lens according to the fifth exemplary embodiment, passes through a light incident portion and is then recovered in paper.
Figure 14A:
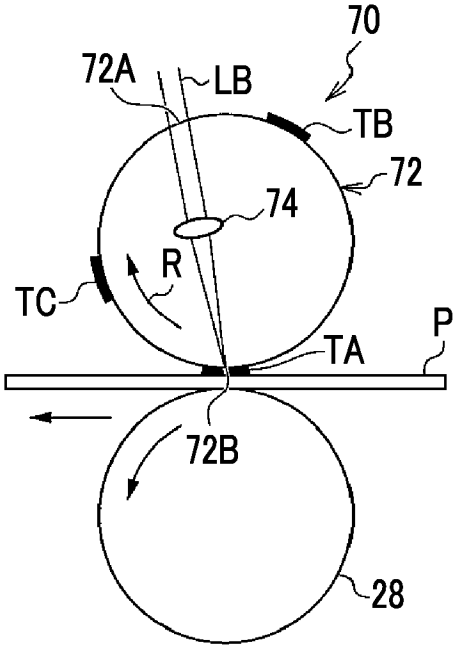

As illustrated in FIG. 14A, when the toner TA which is firstly offset reaches the contact portion 72B by the rotation of the transparent tube 72, the toner TB and the toner TC are not present in the incident portion 72A. This is because the length L5 between the center of the contact portion 72B and the center of the incident portion 72A in the R-direction is different from the length L6 between the center of the incident portion 72A and the center of the contact portion 72B, as described above. In other words, when the toner TA reaches the contact portion 72B, the light beam LB is not scattered or absorbed by the toner TB or the toner TC, and thus energy necessary for fixing onto the paper P is supplied to the toner TA.

As illustrated in FIG. 14B, energy necessary for fixing onto the paper P is supplied to the toner TA, and thus the toner TA which is offset on the transparent tube 72 is fixed onto the paper P. That is, the toner TA is recovered from the outer circumferential surface of the transparent tube 72. For the same reason, when the transparent tube 72 rotates, the toner TB and the toner TC are not located on the light path of the light beam LB again, and thus energy necessary for fixing is supplied to the toner TB or the toner TC when the toner TB or the toner TC reaches the contact portion 72B. Thereby, the toner TB and the toner TC which are offset on the transparent tube 72 are fixed onto the paper P (recovered from the transparent tube 72).

In this manner, in the fixing device 70, even when the toner TB and the toner TC are offset on the transparent tube 72 due to the toner TA being offset on the transparent tube 72, the toner TA, the toner TB, and the toner TC are fixed (recovered) onto the paper P. In other words, it is possible to suppress the toner TA, the toner TB, and the toner TC from remaining on the transparent tube 72 due to insufficient energy. Thereby, in the fixing device 70, it is possible to suppress an increase in the offset of the toner T on the transparent tube 72 occurring due to a part of the light beam LB being shielded by the toner TA which is offset on the transparent tube 72, compared to the comparative example described above. In other words, it is possible to suppress an increase in the toner TA which is further attached to the toner TA attached to the transparent tube 72.

In addition, as illustrated in FIG. 12, in the fixing device 70, the light beam LB is incident on only a portion (incident portion 72A) except for the facing portion 72C in the outer circumferential surface of the transparent tube 72. For this reason, it is possible to prevent the toner T from being attached to the transparent tube 72 for every 180 degrees, compared to a configuration in which the light beam LB is incident not only on a portion different from the facing portion 72C but also on the facing portion 72C. In other words, it is possible to prevent the toner T from being attached to a specific position of the outer circumferential surface of the transparent tube 72 in a biased manner.

Further, in the fixing device 70, the transparent tube 72 is formed to have a tubular shape (hollow) when seen in the Z-direction, and thus the amount of member used is reduced, compared to a configuration in which a solid lens when seen in the Z-direction is used.

In the image forming apparatus 10 (see FIG. 1) including the fixing device 70, an increase in the offset of the toner T on the transparent tube 72 in the fixing device 70 is suppressed, and thus image defect occurring due to the increase in the toner T which is offset on the transparent tube 72 is suppressed.

Meanwhile, the present invention is not limited to the above-described exemplary embodiments.

In the fixing devices 20, 40, 50, and 60, a cylindrical contact member including an incident portion and a contact portion may be used instead of the solid lens 26 insofar as a light beam LB can be condensed on a contact portion. Further, a condensing lens which is disposed inside the contact member and condenses light toward the contact portion may be provided. In addition, in the fixing device 70, the condensing lens 74 and the transparent pad 76 may not be provided.

The number of laser arrays 22 may be another number without being limited to four in the Z-direction. In addition, the number of laser arrays 22 may be another number without being limited to one or five in the R-direction. Further, the arrangement of the plural laser arrays 22 with respect to the facing portion 26C of the lens 26 or the facing portion 72C of the transparent tube 72 may be symmetrical or asymmetrical about the facing portion 26C or facing portion 72C in the R-direction. In addition, the position of the incident portion 26A with respect to the facing portion 26C in the R-direction or the position of the incident portion 72A with respect to the facing portion 72C in the R-direction may be the downstream side without being limited to the upstream side with respect to the facing portions 26C and 72C.

Other optical members except for a collimator lens, a condensing lens, and a transparent pad may be provided between the laser array 22 on the optical axis K of the light beam LB and each contact portions. The collimator lens 24 may cause the light beam LB to be incident on the lens 26 or the transparent tube 72 so that the toner TB shields only a part of the light beam LB when the toner TA is located at the contact portion 26B, or does not shield any of the light beam LB when the toner TA is located at the contact portion 26B.

The fixing devices 20, 40, 50, 60, and 70 may perform fixing by winding a portion of the paper P around the contact portion 26B of the lens 26 or the contact portion 72B of the transparent tube 72 without using the facing roller 28.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a light source;

a contact member that transmits light from the light source and includes a contact portion that contacts with an image forming material on a medium while rotating, the image forming material on the medium being heated by light in the contact portion;

a facing member that comes into contact with the contact member to form a contact portion; and an incidence unit that causes the light from the light source to be incident on the contact member so that a second image forming material, attached to the contact member by a first image forming material attached to the contact member shielding at least a part of the light from the light source, shields only a part of the light when the first image forming material is located at the contact portion, or does not shield any of the light when the first image forming material is located at the contact portion, wherein the incidence unit is configured to cause the light from the light source to be incident on a substantially center of the contact portion in the radial direction of the contact member, and wherein the incidence unit causes the light from the light source to be incident on the contact member so that the second image forming material does not shield any of the light when the first image forming material reaches the contact portion.

2. The fixing device according to claim 1, wherein the incidence unit causes the light from the light source to be incident on the contact member so that an incidence position of the incident light and the contact portion do not face each other at an angle of 180 degrees in a circumferential direction of the contact member.

3. The fixing device according to claim 2, wherein the contact member is formed to have a tubular shape when seen in a rotation axis direction.

4. The fixing device according to claim 2, wherein a width of an incident portion of the contact member on which the light is incident is larger than a width of the contact portion, when the contact member is seen in a rotation axis direction.

5. The fixing device according to claim 1, wherein the contact member is formed to have a tubular shape when seen in a rotation axis direction.

6. The fixing device according to claim 1, wherein a width of an incident portion of the contact member on which the light is incident is larger than a width of the contact portion, when the contact member is seen in a rotation axis direction.

7. A fixing device comprising:

a light source;

a contact member that transmits light from the light source and includes a contact portion that contacts with an image forming material on a medium while rotating, the image forming material on the medium being heated by light in the contact portion;

a facing member that comes into contact with the contact member to form a contact portion: and an incidence unit that causes the light from the light source to be incident on the contact member so that a second image forming material, attached to the contact member by a first image forming material attached to the contact member shielding at least a part of the light from the light source, shields only a part of the light when the first image forming material is located at the contact portion, or does not shield any of the light when the first image forming material is located at the contact portion, wherein the incidence unit is configured to cause the light from the light source to be incident on a substantially center of the contact portion in the radial direction of the contact member, and wherein the incidence unit causes the light from the light source to be incident on the contact member so that an incidence position of the incident light and the contact portion do not face each other at an angle of 180 degrees in a circumferential direction of the contact member.

8. The fixing device according to claim 7, wherein the contact member is formed to have a tubular shape when seen in a rotation axis direction.

9. The fixing device according to claim 7, wherein a width of an incident portion of the contact member on which the light is incident is larger than a width of the contact portion, when the contact member is seen in a rotation axis direction.

10. A fixing device comprising:

a light source;

a contact member that transmits light from the light source and includes a contact portion that contacts with an image forming material on a medium while rotating, the image forming material on the medium being heated by light in the contact portion; a facing member that comes into contact with the contact member to form a contact portion; and an incidence unit that causes at least a part of the light from the light source to be incident on a incident portion of the contact member, wherein the incident portion of the contact member includes a portion, which is different from a facing portion, of an outer circumferential surface of the contact member, the facing portion is shifted from the contact portion by 180 degrees in a circumferential direction, and the incidence unit is configured to cause the light from the light source to be incident on a substantially center of the contact portion in the radial direction of the contact member.

11. The fixing device according to claim 10, wherein the incidence unit causes the light to be incident on only the portion which is different from the facing portion of the contact member.

12. The fixing device according to claim 11, wherein the contact member is formed to have a tubular shape when seen in a rotation axis direction.

13. The fixing device according to claim 11, wherein a width of the incident portion of the contact member on which the light is incident is larger than a width of the contact portion, when the contact member is seen in a rotation axis direction.

14. The fixing device according to claim 10, wherein the contact member is formed to have a tubular shape when seen in a rotation axis direction.

15. The fixing device according to claim 10, wherein a width of the incident portion of the contact member on which the light is incident is larger than a width of the contact portion, when the contact member is seen in a rotation axis direction.

* * * * *